United States Patent [19]

Maxfield

[11] 4,137,577

[45] Feb. 6, 1979

[54] TOILET BOWL CLEANING DEVICE

[76] Inventor: Don A. Maxfield, 8123 Magnolia Ave., Riverside, Calif. 92502

[21] Appl. No.: 868,395

[22] Filed: Jan. 10, 1978

[51] Int. Cl.[2] ..... E03D 9/02

[52] U.S. Cl. ..... 4/231; 4/222; 4/257

[58] Field of Search ..... 4/226, 231, 233, 255, 4/256, 257, 427, 222, DIG. 10; 134/24

[56] References Cited

U.S. PATENT DOCUMENTS

| | | | |
|---|---|---|---|
| 1,323,580 | 12/1919 | Dickey | 4/256 |
| 2,171,710 | 9/1939 | Perry | 4/257 |
| 2,306,444 | 12/1942 | Hubbard | 4/257 |
| 2,327,602 | 8/1943 | Kesteloot | 4/257 X |
| 2,430,976 | 11/1947 | Dutra | 4/DIG. 10 |
| 2,785,561 | 3/1957 | Hoffman | 4/257 X |
| 3,480,021 | 11/1969 | Ewald | 4/255 X |

*Primary Examiner*—Charles E. Phillips
*Attorney, Agent, or Firm*—Harris, Kern, Wallen & Tinsley

[57] ABSTRACT

An article for cleaning a toilet bowl including a plug member for positioning in the drain of a toilet bowl and a flexible tube with one end of the tube carried in the plug member providing a flow path through the plug member. The other end of the tube is adapted for mounting on the bowl above the normal water level, as by a wire bracket which clips over the rim of the bowl. The plug member is preferably made of a water soluble material carrying a cleanser. The upper end of the tube preferably is attached to the rim with a block of water soluble material carrying a cleanser.

9 Claims, 3 Drawing Figures

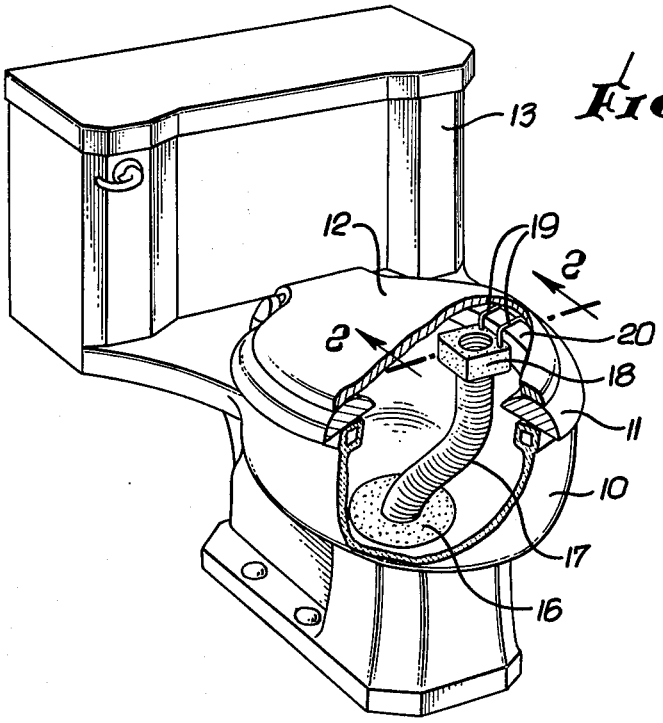
FIG. 1.
FIG. 2.
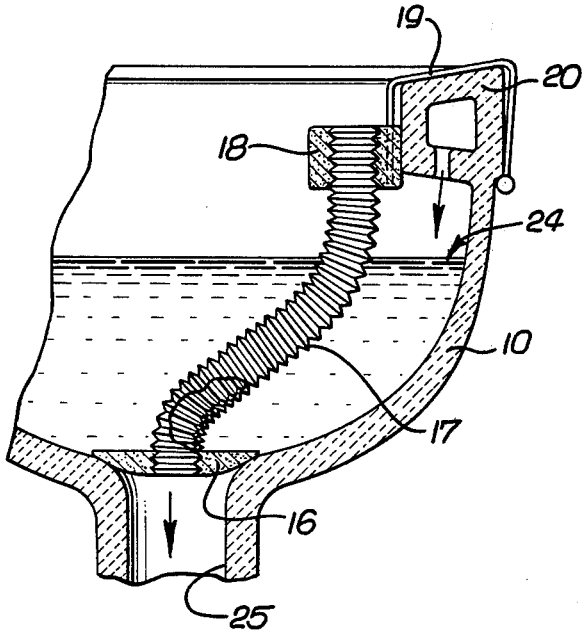
FIG. 3.
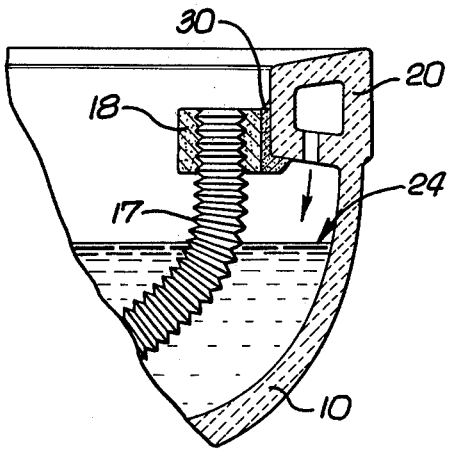

TOILET BOWL CLEANING DEVICE

BACKGROUND OF THE INVENTION

This invention relates to a new and improved article for cleaning a toilet bowl. Water stands in a toilet bowl at a normal level determined by the flush valve mechanism. Dirt tends to accumulate at the water line in the bowl and in areas utilizing hard water, a scale forms at or above the water line. This scale is unsightly and is difficult to remove.

It is an object of the present invention to provide an article which can be utilized for cleaning a toilet bowl. A particular object of the invention is to provide such a device which can be inserted and which then requires no further work on the part of the user.

It is an object of the invention to provide an article for cleaning a toilet bowl which is easily and quickly inserted and which performs the cleaning operation automatically and which may be readily flushed away at the completion of the cleaning operation.

These and other objects, advantages, features and results will more fully appear in the course of the following description.

SUMMARY OF THE INVENTION

The present invention relates to an article for cleaning a toilet bowl including a plug member for positioning in the drain of a toilet bowl, a flexible tube with one end of the tube carried in the plug member providing a flow path through the plug member, and means for mounting the other end of the tube on the toilet bowl at a position above the normal water level in the bowl.

In the preferred form of the invention, the plug member is made of a water soluble material with a cleanser incorporated therein. Also, the flexible tube is made of corrugated paper and the means for mounting the tube on the bowl is made of a water soluble material, thereby providing for disposal of the article on completion of the cleaning operation.

BRIEF DESCRIPTION OF THE DRAWING

FIG. 1 is a perspective view illustrating installation in a toilet bowl of the presently preferred embodiment of the invention;

FIG. 2 is an enlarged partial sectional view taken along the line 2—2 of FIG. 1; and FIG. 3 is a view similar to that of FIG. 2 showing an alternative embodiment of the invention.

DESCRIPTION OF THE PREFERRED EMBODIMENTS

A conventional toilet is illustrated in FIG. 1, with bowl 10, seat 11, cover 12 and tank 13. In the embodiment of the invention illustrated in FIGS. 1 and 2, a plug member 16 is carried at the lower end of a flexible tube 17. The upper end of the tube is carried in a block 18 having wire brackets 19 for positioning over the rim 20 of the bowl.

In the preferred embodiment of the invention, the flexible tube 17 is formed of corrugated paper. The plug member 16 is preferably formed of a water soluble material and preferably has a cleanser mixed therein. A typical water soluble material is carbo-wax, and a suitable cleanser sodium disulfate. The block 18 preferably is made in the same manner as the plug member 16. The block 18 and the plug member 16 preferably are molded about the corrugated tube 17, with the corrugation serving to hold the tube in position.

The normal water level in the bowl is indicated by the arrow 24. The article of the invention may be used by positioning the brackets 19 over the rim of the bowl and dropping the plug member into the bowl. The toilet is then flushed and flow of the water out the drain 25 moves the plug into the position shown in FIG. 2 to plug up the drain. The water level in the bowl will then rise to the upper end of the tube 17 and water flows out the bowl through the tube. This results in a new water level in the bowl at the level of the upper end of the tube 17.

A cleanser, preferably one which will dissolve scale, is now introduced into the bowl. This may be done by the user, but in the preferred embodiment described above, the cleanser is introduced by the plug member 16 and/or the block 18 dissolving in the water and releasing the cleanser mixed with the water soluble material. The dissolving and cleansing action continues until the plug member 16 is dissolved to a state which permits water to pass from the bowl outward through the drain. Preferably, the block 18 and the plug member 16 are proportioned so that the block 18 dissolves first permitting the tube 17 to drop into the bowl. Then after the plug member 16 dissolves, the tube can be flushed down the drain, and the bowl cleaning operation is completed.

An alternative arrangement for attaching the device to the toilet bowl is shown in FIG. 3, where components corresponding to those of FIGS. 1 and 2 are identified by the same reference numbers. In this embodiment, the block 18 is attached to the rim 20 by an adhesive 30. In the preferred arrangement, the adhesive is affixed to the block 18 at the time of manufacture of the device. The outer surface of the adhesive may be covered by a peelable layer which the user peels off prior to pressing the adhesive surface of the block against the rim of the bowl. Once the article is installed, the operation is the same as described previously.

I claim:

1. An article for cleaning a toilet bowl, comprising in combination:

a plug member for positioning in the drain of a toilet bowl;

a flexible tube with one end of said tube carried in said plug member providing a flow path through said plug member; and means for mounting the other end of said tube on the toilet bowl at a position above the normal water level in the bowl, said means for mounting including a block of water soluble material with said other end of said tube carried in said block.

2. An article as defined in claim 1 wherein said means for mounting includes a bracket adapted for positioning over the rim of the bowl.

3. An article as defined in claim 1 including a cleanser mixed in said water soluble material of said block.

4. An article as defined in claim 1 wherein said means for mounting also includes a bracket carried in said block and adapted for positioning over the rim of the bowl.

5. An article as defined in claim 1 wherein said means for mounting also includes an adhesive for affixing said block to the interior of the toilet bowl.

6. An article for cleaning a toilet bowl, comprising in combination:

a plug member for positioning in the drain of a toilet bowl, said plug member comprising a water soluble material;

a flexible tube with one end of said tube carried in said plug member providing a flow path through said plug member; and means for mounting the other end of said tube on the toilet bowl at a position above the normal water level in the bowl.

7. An article as defined in claim 6 including a cleanser mixed in said water soluble material of said plug member.

8. An article as defined in claim 6 wherein said tube is of corrugated paper, with said plug member molded about said tube.

9. An article as defined in claim 8 wherein said means for mounting includes a block of water soluble material with the other end of said tube carried in said block.

* * * * *